US007603813B2

(12) United States Patent
Hackl

(10) Patent No.: US 7,603,813 B2
(45) Date of Patent: Oct. 20, 2009

(54) DOOR GAP MONITORING

(75) Inventor: Friedrich Hackl, Winklarn (AT)

(73) Assignee: Knorr-Bremse Gesellschaft Mit Beschrankter Haftung, Modlich (AT)

( * ) Notice: Subject to any disclaimer, the term of this patent is extended or adjusted under 35 U.S.C. 154(b) by 579 days.

(21) Appl. No.: 10/515,199

(22) PCT Filed: May 20, 2003

(86) PCT No.: PCT/EP03/05269

§ 371 (c)(1),
(2), (4) Date: Nov. 7, 2005

(87) PCT Pub. No.: WO03/097977

PCT Pub. Date: Nov. 27, 2003

(65) Prior Publication Data

US 2006/0070820 A1 Apr. 6, 2006

(30) Foreign Application Priority Data

May 22, 2002 (AT) ..... A 780/2002

(51) Int. Cl.
*E06B 3/00* (2006.01)

(52) U.S. Cl. ..... 49/506; 49/27; 49/28; 49/120; 49/370

(58) Field of Classification Search ..... 49/26, 49/27, 28, 118, 120, 370, 367, 506; 318/286, 318/283, 282, 466, 369
See application file for complete search history.

(56) References Cited

U.S. PATENT DOCUMENTS 4,338,587 A * 7/1982 Chiappetti ..... 340/928
4,803,807 A 2/1989 Stockermann et al.
5,072,080 A 12/1991 Beckhausen
5,280,754 A * 1/1994 Flanagan et al. ..... 105/341
5,433,031 A * 7/1995 Dailey ..... 49/27
RE36,825 E * 8/2000 Dailey ..... 49/27
6,125,591 A * 10/2000 Schmidhuber et al. ..... 49/477.1
6,133,948 A * 10/2000 Abbott et al. ..... 348/161
6,310,548 B1 * 10/2001 Stephens et al. ..... 340/540
6,339,305 B1 * 1/2002 Ishihara et al. ..... 318/445

(Continued)

FOREIGN PATENT DOCUMENTS

CH 688 354 A5 8/1997

(Continued)

*Primary Examiner*—Katherine W Mitchell
*Assistant Examiner*—Catherine A Kelly
(74) *Attorney, Agent, or Firm*—Barnes & Thronburg LLP

(57) ABSTRACT

The present disclosure relates to a method of monitoring a door gap to determine whether a proper final closed position of doors exists after a closing of doors of rail vehicles, or other vehicles or elevators. The vehicles or elevators have at least one door leaf which is equipped on its main closing edge with an elastically deformable or elastically mounted profile. The position and/or shape of the profile is detected by electric, pneumatic, optical, inductive, capacitive or magnetic sensors or a combination of such sensors in connection with an electronic monitoring system which analyzes the signals of the sensors and, if applicable, determines the existence of the door gap. The method steps include closing the doors, activating the electronic monitoring system after the closing of the doors; monitoring the door gap and determining a final closed position of the doors by the electronic monitoring system.

5 Claims, 3 Drawing Sheets

U.S. PATENT DOCUMENTS

| | | | | |
|---|---|---|---|---|
| 6,427,382 | B2 * | 8/2002 | Gregoriou et al. | 49/27 |
| 6,525,659 | B2 * | 2/2003 | Jaffe et al. | 340/545.6 |
| 6,571,512 | B1 * | 6/2003 | Miller et al. | 49/27 |
| 6,683,296 | B2 * | 1/2004 | Miller et al. | 250/221 |
| 6,779,302 | B2 * | 8/2004 | Harrison et al. | 49/26 |
| 6,906,487 | B2 * | 6/2005 | de Frutos | 318/468 |
| 7,000,352 | B2 * | 2/2006 | Ishihara et al. | 49/28 |
| 7,044,271 | B2 * | 5/2006 | De Coi | 187/316 |
| 7,170,244 | B2 * | 1/2007 | Choby | 318/280 |
| 2001/0045062 | A1 * | 11/2001 | Gregoriou et al. | 49/27 |
| 2002/0043948 | A1 * | 4/2002 | Ogasawara | 318/445 |
| 2002/0144467 | A1 * | 10/2002 | Teich | 49/506 |

FOREIGN PATENT DOCUMENTS

| | | | |
|---|---|---|---|
| DE | 35 20 577 | A1 | 12/1986 |
| DE | 37 06 450 | A1 | 9/1987 |
| DE | 37 24 942 | A1 | 2/1989 |
| EP | 1 054 128 | A2 | 11/2000 |
| EP | 1 509 665 | B1 | 3/2005 |

* cited by examiner

DOOR GAP MONITORING

BACKGROUND AND SUMMARY OF THE DISCLOSURE

The disclosure relates to a method of monitoring the door gap of doors of rail vehicles, elevators, or the like.

Swiss Patent Document CH 688 354 A relates to the problem on which the disclosure is based which is that of detecting the jamming-in of small or thin objects when closing doors. The solution suggested by this document is the following: Hollow profiles are provided on the closing edges and have at least one cross-sectional area responsible for the sealing and at least one cross-sectional area responsible for detecting thin jammed-in objects. The area responsible for determining jamming-in events is constructed such that, also in the closed final position of the door, in the disturbance-free operation, it is subjected to no deformation. On the other hand, it is constructed such that it is impossible to bring objects, also thin objects, normal to the closing plane, into the detection area of the profile without deforming this area when the closing operation is completed or almost completed. This is achieved in that the detection areas of the two profiles have an overlapping construction in the direction normal to the closing plane, whereby each object extending diagonally or normal to the closing plane and projecting through the plane leads to a deformation of this area.

This solution requires that the detection areas of the profile do not deform during the closing operation despite the occurring vibrations and shocks, which, however, is not so in practice. For example, as a result of aging processes or damaging of the plastic profile, it may occur that the two actual sensor edges do not move past one another but strike again one another and thereby trigger an alarm.

U.S. Pat. No. 4,803,807 A corresponding to European Patent Document EP 0 254 038 A suggests that the closing force of a pneumatically operated door leaf be monitored by a closing force sensor and, in the event of the exceeding of a preset limit value, that the cylinder be lifted by a solenoid valve in order to make it possible to free the jammed-in object or the squeezed-in person. Also this arrangement is activated along the entire closing path and therefore has to be set to be slow or insensitive in order not to be activated erroneously. European Patent Document EP 1 054 128 A provides, in the case of vehicle doors (only pneumatic drives are disclosed), that the closing force during the entire closing movement and for a certain time beyond it (this time can be defined either by the speed of the vehicle, by a time switch, by a manual operation or other factors) be limited to a defined, not very high value. This is to make it possible to free jammed-in objects or persons, in that the door is opened against this low closing force and the jamming-in is eliminated. For safety reasons, this closing force is markedly increased only after the time has elapsed, in order to reliably avoid an opening of the door during the travel. The jamming-in of thin objects cannot be detected by means of this arrangement.

In general terms, the many different safety devices in the case of doors of rail vehicles or elevators, but also gondolas of cable cars, etc., monitor many different parameters, particularly during the closing of the door. This may be the force required for the closing, from which it is derived whether the pressure of objects or persons against the door prevents the closing movement. This may be the closing speed, from which conclusions can be drawn also with respect to jammed-in persons or objects. This may be deformations on the main closing edge, which is usually formed of a relatively voluminous rubber profile, indicating that the door has encountered an obstacle in the course of the closing movement; and similar situations.

The reaction to the determination of an obstacle or a jammed-in object or of a body part, differs according to the application. In some cases, it is required that the closing movement be changed into an opening movement, and the door does not start the closing movement again before a predetermined time has elapsed. In other cases, only a stoppage of the door for a predetermined time period is required. In even other cases, only a brief and locally limited reversal of the movement takes place for allowing the squeezed-in persons to free themselves. There are also many other possibilities. Door control systems also exist in which the reaction to the detection of a jammed-in object is different the first time during a closing movement than subsequently in order to prevent vandals and saboteurs from willfully blocking the closing of the door.

In the case of all these systems, the position in which the door is during the closing when it impacts on an obstacle must be determined because the reactions should be different depending on the position. In the final closing end range, in which the main closing edge of the door leaf has approached the door frame or the main closing edge of the second door leaf to such an extent that no arm or leg or bag or similarly voluminous object can be squeezed in because this would otherwise already have been determined in a more open position of the door leaf, as a result of the dynamic stressing of the door leaf and the connected vibrations and shocks. In this final closing range, the reaction threshold of the sensors is increased to an extreme degree, or the safety devices are completely switched off in order to permit a closing of the door, without an opening of the door taking place only as a result of vibrations occurring during the movement into the closed final position.

These systems have essentially been successful. However, in the course of efficiency and savings measures, changes are being made. Not only are elevators operated unmanned but also subways, commuter trains and the like. The operation is monitored only from a central master station location, which can take place with clearly less personnel than in the conventional manned operation.

In contrast to the manned operation, this type of operation carries the risk that thin objects may be squeezed in at the end of the closing end movement without any detection of this squeezing-in by the conventional safety systems. Since no visual control takes place along the train, this previously easy and reliable detection of the jamming-in of a walking cane, a crutch, a dog leash, and the like becomes impossible in this new type of operation and thus leads to a spectacular risk.

It is an object of the present disclosure to avoid this risk and to suggest a protection which is capable of reliably detecting such objects or their squeezing-in.

As indicated above, it is not necessary for the door gap monitoring according to the present disclosure to be activated during the closing of the door. The door gap monitoring therefore does not change the behavior of a given automatic closing system and can therefore also be installed subsequently in an easy manner and without any problems.

It is essential that the device or the method for monitoring the door gap is activated or analysis carried out after the closing of the doors has taken place. It is then determined whether the shape of the main closing edge of the door, normally formed of an elastic material, corresponds to the shape which correlates with the proper closed condition of the door or whether it is deformed, which is interpreted as the result of a jammed-in object and triggers a report or an alarm.

In principle, a physical quantity is therefore measured which corresponds to the shape or the position of the gap/profile and is compared with the quantity of the proper shape/position of the gap/profile.

These and other aspects of the present disclosure will become apparent from the following detailed description of the disclosure, when considered in conjunction with accompanying drawings.

DETAILED DESCRIPTION OF THE DRAWINGS

Figure 1:
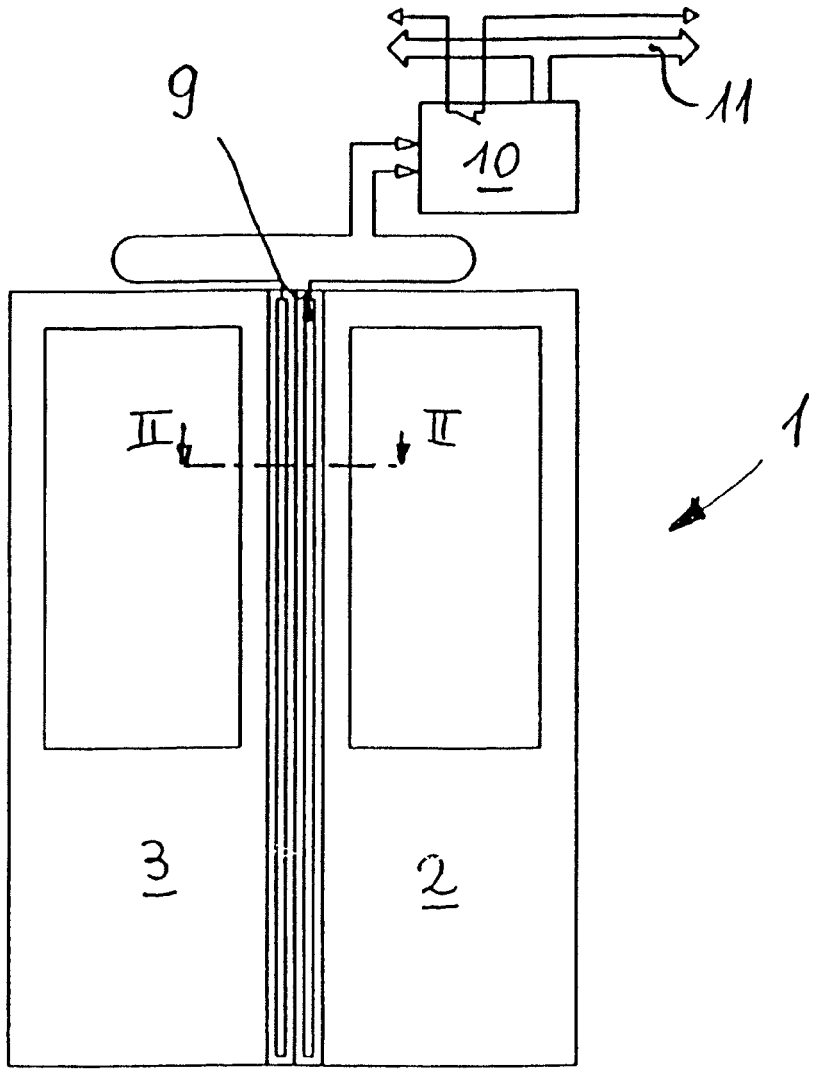
FIG. 1 is a schematic view of a first embodiment of the present disclosure.

FIG. 1 illustrates a first embodiment of the disclosure. A door, which in its entirety has the reference number 1, has two door leaves 2, 3, each of which being equipped with an elastic profile 4 (FIG. 2) in the area of its main closing edge. The profile 4 essentially is the jambs of the door leaves 2, 3 and is provided with undercut areas 5 which facilitate a mounting on the face of the door leaf. The actual face 6 of the profile 4 has a curved construction in order to, even when the door leaves do not mutually abut in a precisely aligned manner, arrive at a sealing condition of the main closing edges. Furthermore, the shape of the profile 6 has a certain adjusting effect by means of which the tolerances in the guidance of the door leaves can be compensated.

In addition, the profile 4 has two cavities—an approximately triangular cavity 7 and a more slot-type cavity 8. The two cavities extend parallel to the main closing edge, coinciding with the face 6 and have the following tasks: The approximately triangular cavity 7 provides the profile 4 with flexibility when objects are jammed in between the faces 6. The cavity 8 also deforms when objects are jammed in between the faces 6. This deformation is monitored by contact strips 9', 9" which come in contact with one another already in the event of a slight deformation of the shape of the cavity 8 and in the process short-circuit a monitoring circuit.

The cable routing and the arrangement of the monitoring unit is illustrated purely schematically in FIG. 1. From each of the contact strips, which in their entirety have the reference number 9, a signal cable, which can go along in the opening and closing movement of the door leaf, leads to a signal generator unit 10, from which, in turn, by way of control lines 11, the corresponding signals "door properly closed" or "jammed-in object in the door" are transmitted to the train control center, where the correspondingly provided reactions are triggered.

Figure 2:
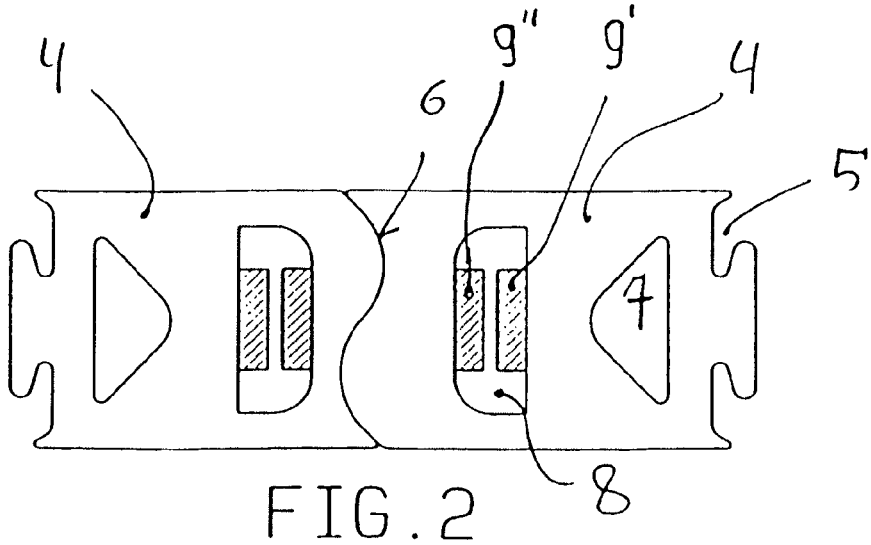
FIG. 2 is a cross-sectional view taken along lines II-II of FIG. 1.

In the embodiment according to FIGS. 1 and 2, naturally a magnetic or capacitive system can be used instead of the contact strips 9. This system can be easily laid out by a person skilled in the field of sensor technology in the knowledge of the invention and can be adapted to the respective situations.

Figure 3:
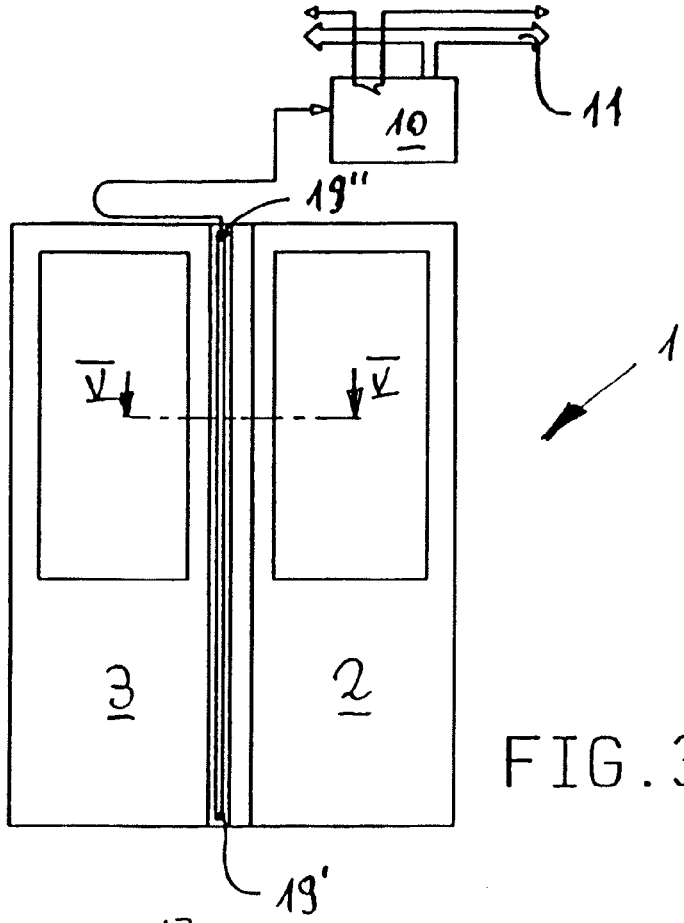
FIGS. 3 to 5 are views similar to those of FIGS. 1 and 2 of a second embodiment of the present disclosure.
Figure 4:
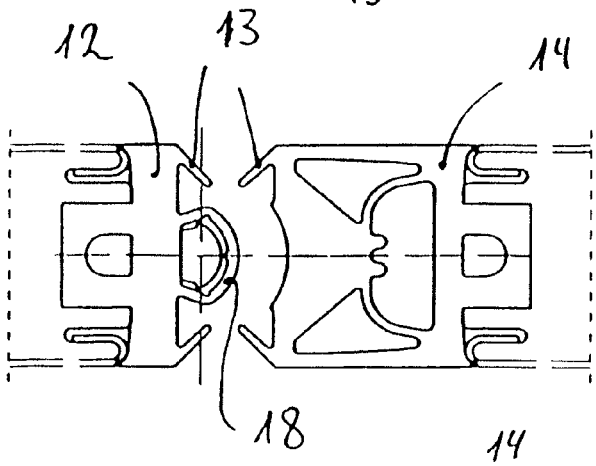
Figure 5:
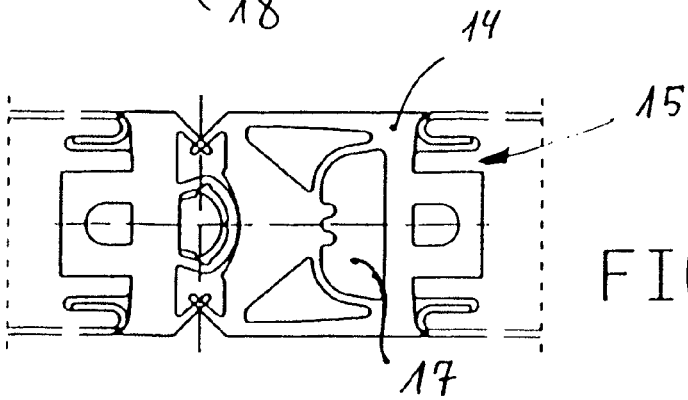

FIGS. 3 to 5 represent a variant which has an optical basis. As illustrated by the coherence of FIGS. 4 and 5, the two door leaves 2 and 3 of this variant have differently constructed strips 12, 14. In the prior art, such profiles are used as special finger protection profiles. The sealing takes place by lips 13 provided on each of the two profiles. A cylindrical tube 18, which additionally has a thin-walled construction, is slightly deformed in the closed condition (FIG. 5) and also contributes to the sealing and the acoustic insulation.

An optical or infrared transmitter 19' (FIG. 3) is situated at the lower end of the strip 12 in the area of the cavity of the tube 18, and a corresponding receiver 19" is situated at the other end of the tube 18. When now even a very thin object is jammed in between the profiles 12, 14, the tube 18 is squeezed together, the light beam is interrupted and the receiver 19" triggers an alarm by way of the electronic monitoring system 10 and the line 11.

Figure 6:
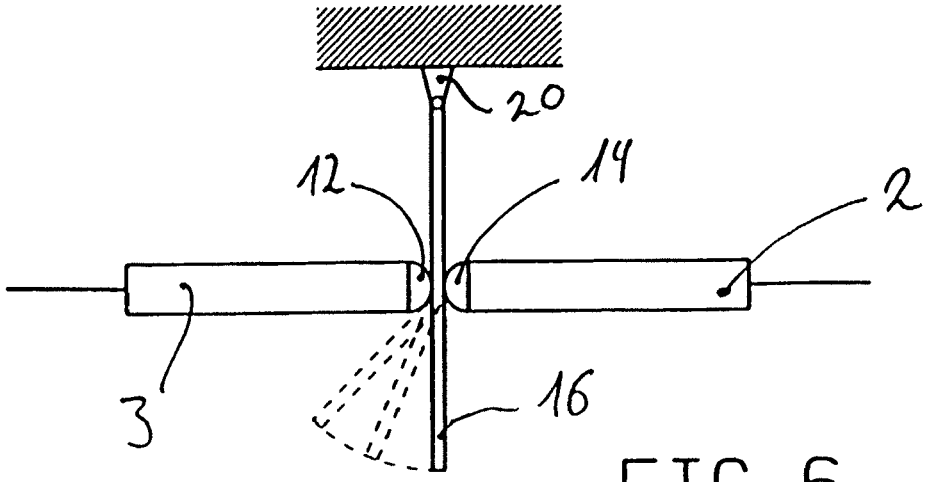
FIG. 6 is a schematic view of a testing arrangement.

FIG. 6 shows the method of operation of the devices according to the present disclosure when, for example, a dog's leash is squeezed in by a testing arrangement for testing the sensitivity of the device. In the direction normal to the plane of the door leaves 2, 3, a dog leash or the like 16 is fixed at one end to a fitting fastening at a linking point 20. In this case, the leash 16 extends in the tightened condition from the linking point 20 to the door gap between the profiles 12, 14 (or the profiles 4) normal with respect to the door leaf plane. Then, the leash 16 is swivelled in a horizontal line with a defined constant pull, as indicated by the broken-line, and the angle is determined at which the system triggers an alarm. Naturally, the pull necessary for triggering the alarm can also be determined inversely thereto at a defined angle.

In this manner, jammed-in flexible objects of an extremely small cross-section can also be detected as being squeezed in. Devices according to the invention are capable of detecting stiff test pieces of a diameter starting at 6 mm and flexible line-type or string-type structures of a thickness of 1 mm at a pull-out direction of only 15° with respect to the normal line onto the door plane and a tensile loading of 80 N in the string-type structure. In comparison, the conventional monitoring devices used during the closing can detect only objects of a dimension of at least 20×80 or 30×60 mm. In addition to causing the problems of a self-activation as a result of shocks in the closing end area, they are therefore not suitable for the purposes according to the invention also based on their geometric sensitivity.

The present system can be modified in various manners. Thus, the profile can be constructed with only one cavity—cavity 8—and without cavity 7. In the embodiment according to FIGS. 3 to 5, an electric monitoring by means of contact strips can be used instead of the monitoring by means of infrared light. The contact strips are arranged, for example, glued onto the interior side of the front section of the cylindrical tube 18. In this case, the devices 19' and 19" are naturally eliminated.

It is not necessary that an elastic profile 4 is provided on the main closing edge if it also protects the sensor from damage. Particularly in the case of elevator doors, the deformation can be found without such a profile. Even when such a profile is present, it does not have to consist of an elastomer material but can be an elastically disposed profile which, however, is "rigid" in itself. In this case, preferably its position, specifically the elastic bearing, is monitored by at least one sensor.

Particularly in the case of elevator doors but, in principle, in the case of all single-leaf doors, a profile whose shape is monitored can be fastened on the door frame instead of the door leaf, whereby all problems of the movable signal lines and of mechanically stressed sensors are eliminated.

It is conceivable and in many cases advantageous to activate the sensors provided not at the moment of the end of the closing movement of the door leaves (or just before) but with a certain delay, in order to avoid that, as a result of possible shocks and vibrations of the door leaves, the sensors erroneously detect a "jammed-in condition" and trigger an alarm.

Depending on the door type, the delay of the activation can comprise intervals in the range of less than one second to several seconds.

Likewise, it is advantageous to deactivate the sensors some time after the determination of the proper closing condition, or when leaving the station, either individually or by the train control. This is to avoid a false alarm during the trip and to not keep the sensors activated too long.

It is naturally conceivable to keep the sensors activated longer or even constantly and only to omit or ignore the analysis of the signals originating from them. But, because of the stressing of the sensors and the complexity of the analysis, this represents a less desirable embodiment and is, in any case, included under "activation of the device", as a whole.

Although the present disclosure has been described and illustrated in detail it is to be clearly understood that this is done by way of illustration and example only and is not to be taken by way of limitation. The scope of the present disclosure is to be limited only by the terms of the appended claims.

The invention claimed is:

1. A method of monitoring a door gap to determine whether a proper final closed position of doors exists after a closing of doors of rail vehicles, or other vehicles or elevators, the vehicles or elevators having at least one door leaf, which at least one door leaf is equipped on its main closing edge with an elastically deformable or elastically mounted profile, whose position and/or shape is detected by electric, pneumatic, optical, inductive, capacitive or magnetic sensors or a combination of such sensors in connection with an electronic monitoring system which analyzes the signals of the sensors and, if applicable, determines the existence of the door gap due to problems which could include a jamming-in of an object or a person in the door gap, the method steps comprising:

moving the doors to the closed position;

activating the electronic monitoring system after a predetermined time delay after the doors are closed;

monitoring the profiles and determining a final closed position of the profiles by the electronic monitoring system; and deactivating the electronic monitoring system after a predetermined time interval or when a predetermined event occurs.

2. The method according to claim 1, wherein the predetermined event is the reaching of a defined speed of the vehicle.

3. The method according to claim 1, wherein the predetermined event is the passing by a signal generator on the route of the vehicle.

4. The method according to claim 1, wherein the electronic monitoring system has a delay element which causes the activation of the electronic monitoring system after the predetermined time interval, starting with the reaching of the final closed position of each of the door leaves.

5. The method according to claim 1, wherein a measured quantity by the sensors which corresponds to the actual shape or position of the mounted profile, is transmitted to the electronic monitoring system, and is compared with a reference quantity which corresponds to a measured quantity of the shape or position of the profile in the final closed condition of the profile.

* * * * *